US005590821A

United States Patent [19]

Reber

[11] Patent Number: 5,590,821

[45] Date of Patent: Jan. 7, 1997

[54] METHOD AND APPARATUS FOR FOLDING AND PRESSING BINDINGS AND RUFFLES

[76] Inventor: James K. Reber, 10481 NW. 107th Ave., Granger, Iowa 50109

[21] Appl. No.: 383,994

[22] Filed: Feb. 6, 1995

[51] Int. Cl.[6] ..... D05B 35/08; D06J 1/00

[52] U.S. Cl. ..... 223/34; 223/35; 223/28

[58] Field of Search ..... 223/33, 34, 35, 223/36, 28, 1; 112/152, 153

[56] References Cited

U.S. PATENT DOCUMENTS

| | | | |
|---|---|---|---|
| 2,505,897 | 5/1950 | Hoffman | 112/152 |
| 2,714,478 | 8/1955 | McCusker | 223/33 |
| 3,203,385 | 8/1965 | Micale | 112/152 |
| 3,216,024 | 11/1965 | Menhart | 223/28 |
| 3,316,667 | 5/1967 | Harny | 223/33 |
| 3,331,150 | 7/1967 | Harny | 223/33 |
| 3,402,474 | 9/1968 | Janeiro | 33/2 R |
| 3,430,591 | 3/1969 | Kendall | 223/35 |

FOREIGN PATENT DOCUMENTS

| | | | |
|---|---|---|---|
| 480615 | 7/1953 | Italy | 33/2 R |

OTHER PUBLICATIONS

One (1) sheet titled "Clover Notions" from catalog entitled Quilters' Resources.

*Primary Examiner*—Bibhu Mohanty

*Attorney, Agent, or Firm*—Henderson & Sturm

[57] ABSTRACT

A binding tool for assisting in the task of folding and pressing bindings and ruffles and to a method of use thereof. The binding tool has a tool body having a top side and a bottom side and a slot disposed through the body for receiving a strip of cloth to be folded. The binding tool is used by placing the body member onto the top of an ironing board whereby the slot extends from the top of the ironing board upwardly through the body member. One end of a strip cloth is folded and then threaded through the slot from the top of the body down so that it extends between the body and the top of the ironing board. A heated iron is placed on a portion of the folded strip of cloth and then the strip of cloth is pulled through the slot whereby it is folded and simultaneously pulled under the iron and between the iron and the ironing board whereby it is pressed. The binding tool body also has a mechanism thereon for adjusting the effective width of the slot to correspond approximately to the width of the cloth in a folded condition thereof. Straps are provided for attaching the binding tool body securely to the top of an ironing board, although other fastening devices can be used instead.

7 Claims, 3 Drawing Sheets

METHOD AND APPARATUS FOR FOLDING AND PRESSING BINDINGS AND RUFFLES

TECHNICAL FIELD

The present invention relates to a method and apparatus aiding the quilter and home sewer in the task of folding and pressing bindings and ruffles and more particularly to such a method and apparatus that can quickly, easily and dependably perform such task with a minimum of time and effort.

BACKGROUND ART

The traditional way of folding and pressing a binding or ruffle is shown in FIG. 10 of the drawings whereby a first portion of a strip of cloth is first folded by hand and then this folded portion is pressed on an ironing board. Then a second portion of the strip of cloth is folded and then pressed just like the first portion until the entire strip of cloth is folded and pressed. This manual folding and pressing process is a difficult, slow and tedious process.

Attempts have been made to pull a funnel-like member over a strip of cloth, to fold the cloth and then to press the strip of cloth. Such attempts and devices do not hold cloth down onto the ironing board so the pressing is not as precise as is desired. Also, to perform this process, a user must buy and use different sizes for different widths of binding cloth. This is a problem also because these devices are available only in standard sizes and it is sometimes desired to fold non-standard sizes.

Accordingly, there is a need in this industry to have methods and devices for solving the aforementioned problems.

DISCLOSURE OF THE INVENTION

The present invention relates to a binding tool for assisting in the task of folding and pressing bindings and ruffles and to a method of use thereof. The binding tool has a tool body having a top side and a bottom side and a slot disposed through the body for receiving a strip of cloth to be folded. The binding tool is used by placing the body member onto the top of an ironing board whereby the slot extends from the top of the ironing board upwardly through the body member. One end of a strip cloth is folded and then threaded through the slot from the top of the body down so that it extends between the body and the top of the ironing board. A heated iron is placed on a portion of the folded strip of cloth and then the strip of cloth is pulled through the slot whereby it is folded and simultaneously pulled under the iron and between the iron and the ironing board whereby it is pressed. The binding tool body also has a mechanism thereon for adjusting the effective width of the slot to correspond approximately to the width of the cloth in a folded condition thereof. Straps are provided for attaching the binding tool body securely to the top of an ironing board, although other fastening devices can be used instead.

An object of the present invention is to aid the quilter and home sewer in the task of holding and pressing bindings and ruffles.

Another object of the invention is to make the process of folding and pressing bindings and ruffles quicker, easier and more precise.

A still further object of the present invention is to provide a binding tool which is adjustable within a certain chosen range to any size.

A still further object of the present invention is to provide a binding tool which is usable for double folds.

Other objects, advantages, and novel features of the present invention will become apparent from the following detailed description of the invention when considered in conjunction with the accompanying drawings.

BEST MODE FOR CARRYING OUT THE INVENTION

Figure 1:
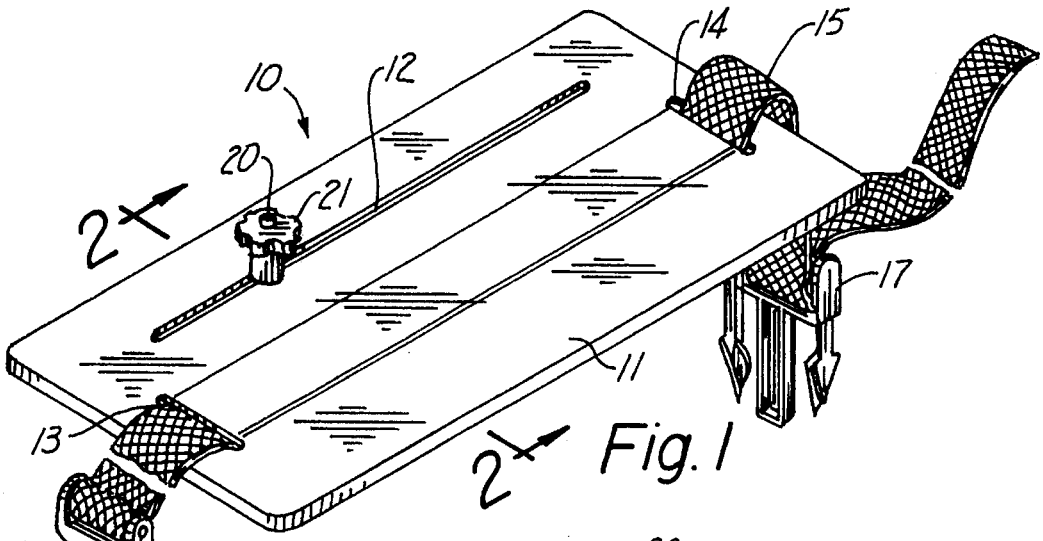
FIG. 1 is a perspective view of a preferred embodiment of the present invention shown before it is attached to an ironing board.

Referring now to the drawings wherein like reference numerals designate identical or corresponding pans throughout the several views, FIG. 1 shows a binding tool (10) constructed in accordance with the present invention. The binding tool (10) includes a body member (11) with a long slot (12) extending therethrough and two short slots (13) and (14), The body member (11) is preferably formed of a transparent polycarbonate product which can be purchased under the trademark name of LEXAN® other clear plastic material, although the body member (11) can be made of other materials if desired. A nylon cloth belt (15) extends through both of the slots (13 ) and (14) as is shown in FIG. 1 wherein the major portion of the cloth is underneath the body (11) so as to not interfere with the passing of material over the top of the body member (11 ) as will be further explained below.

A first buckle (16) is attached to one end of the strap (15) and another buckle (17) is attached to the other end of the strap (15). The strap (15) can be adjusted in length in a conventional manner by the use of well known type of buckle (17).

Figure 2:
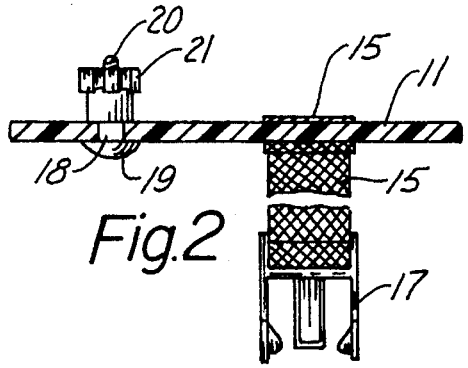
FIG. 2 is a cross sectional view taken along line 2—2 of FIG. 1.
Figure 10:
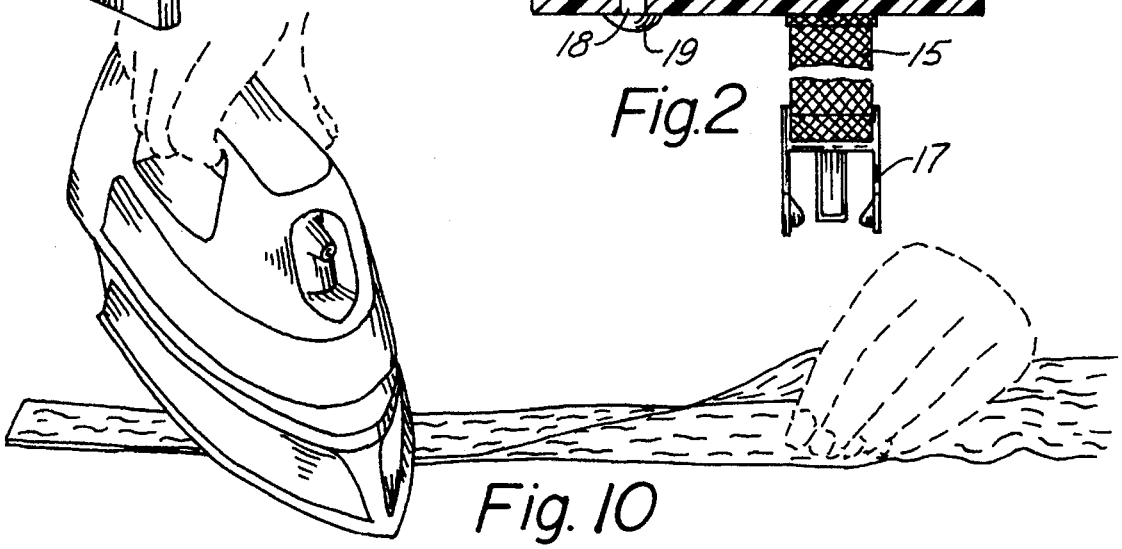
Fig. 10 Prior Art
FIG. 10 shows a prior art method of folding a binding.

Referring to FIGS. 1 and 2, it is noted that a bolt (18) has an enlarged head (19) on one end thereof and the bolt (18) is externally threaded as shown at the end (20) thereof. A hard plastic member (21) is internally threaded like a nut in order to be threadably engaged with the bolt (18) and the threaded end (20) thereof. By tightening down the threaded member (21), it will be held in place with the bolt member (18) by friction. So when it is desired to move the bolt (18)

and member (21), the member (21) would merely be loosened and then slid along the slot (12) to the desired position and then tightened down again such that the enlarged head (19) frictionally engages the bottom of the body member (11) below the slot (12) and the enlarged nut (21) will engage the top of the body member (11) at the top of the slot (12) to hold the member (21) in place as a guide member as will be explained below.

Figure 3:
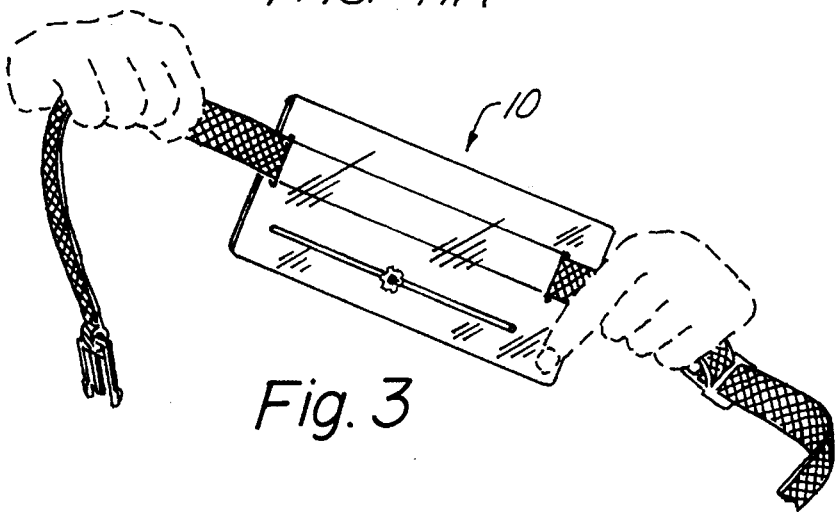
FIG. 3 shows the binding tool in preparation of being strapped to an ironing board.
Figure 4:
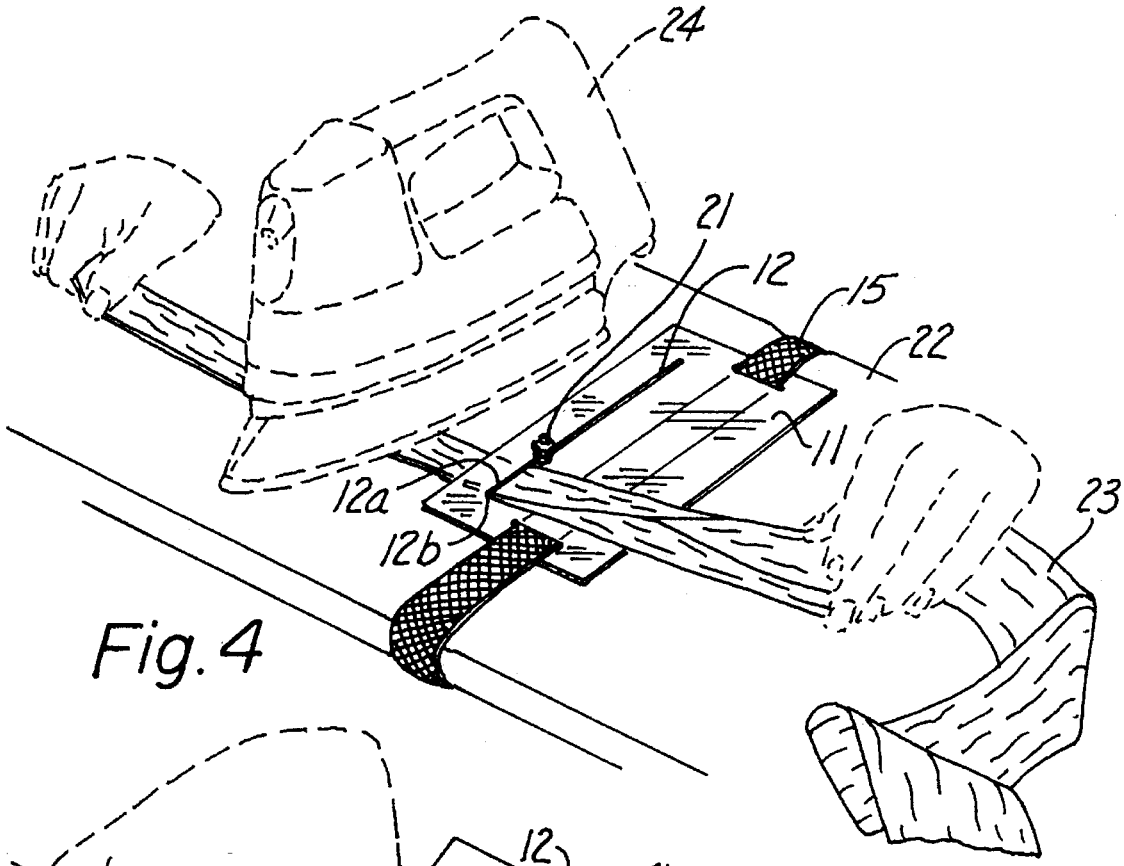
FIG. 4 shows the binding tool attached to an ironing board and in use.

To use the binding tool (11) shown in FIG. 1, the user would first grasp the binding tool (10) in the position shown in FIG. 3 and wrap it around an ironing board (22) as shown in FIG. 4. Then the buckles (16) and (17) would be engaged in the usual fashion and the loose end of the strap (15) would be pulled to securely tighten the strap (15) around the ironing board (22), thereby holding it tightly on top of the ironing board (22).

The next step is to take a strip of cloth, such as strip (23) shown in FIG. 4, and fold it in half on the left end as shown in FIG. 4 and thread that folded end through portion (12*a*) of the slot (12) wherein the strip of cloth (23) as folded is approximately the same width as the distance between the nut (21) and the edge (12*b*) of the slot (12).

It will be noted that the top portion of the binding tool (11), where the cloth (23) passes over it does not have a strap thereon and consequently will smoothly glide across the top thereof, yet once the cloth (23) passes through the shortened slot (12*a*), it is not only automatically folded but also held down by the left side of the binding tool body (11 ) as shown in FIG. 4 so that it can he easily pressed when it passes underneath an iron (24), shown resting on top of the ironing board (22).

Figure 5:
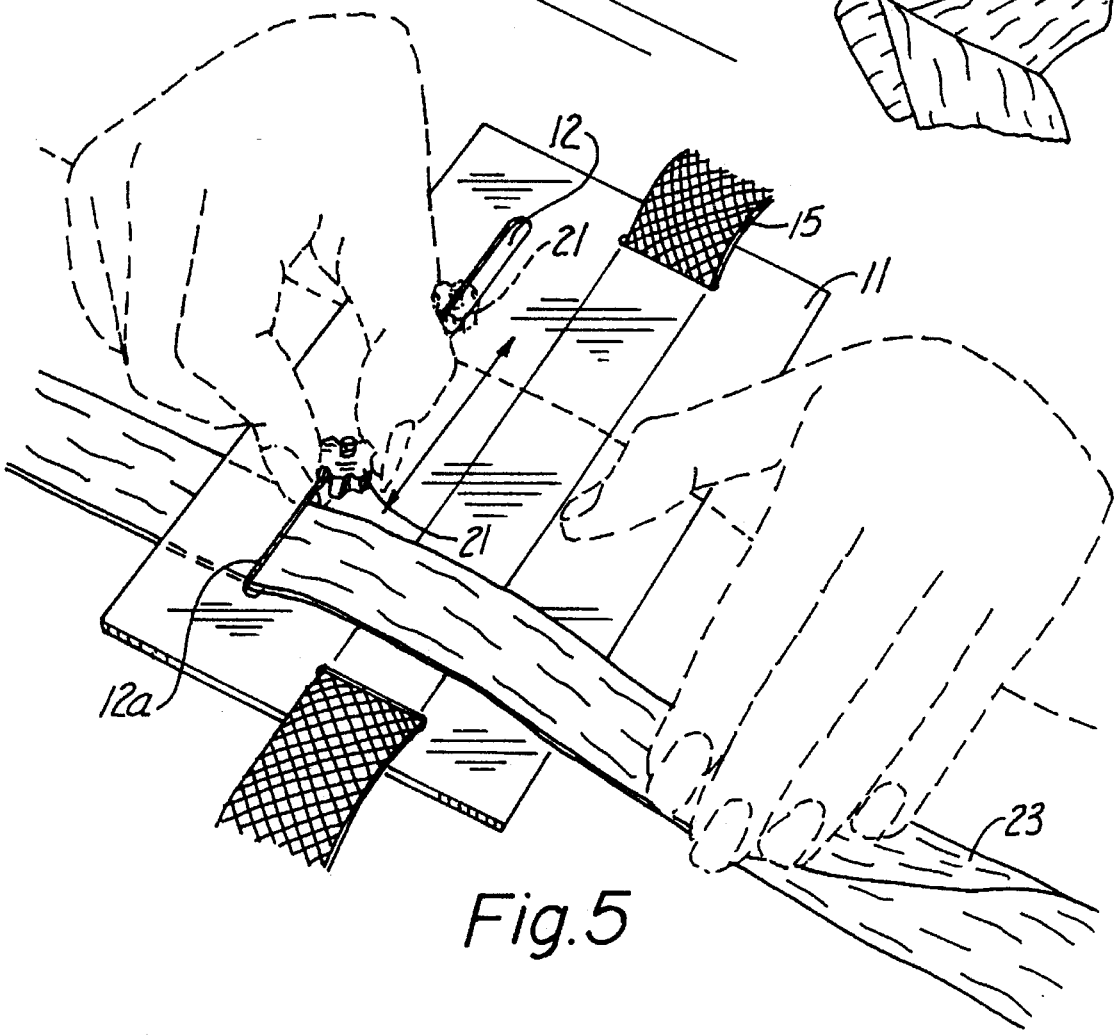
FIG. 5 shows how the effective width of the slot is adjusted to the approximate width of the cloth in a folded condition.

FIG. 5 shows how the slot (12*a*) can be adjusted in size by loosening the nut (21) and moving it to the desired position, for example from the position shown in dashed lines in FIG. 5 to the position shown in solid lines in FIG. 5, where it becomes a guide to aid in the folding process of the cloth strip (23).

Figure 6:
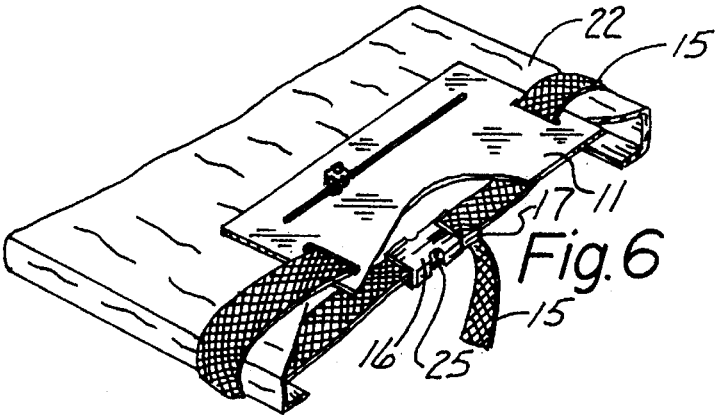
FIG. 6 is a perspective view showing the position of the attaching strap with a portion of the binding tool cut away to show the buckle in its fastened position.

Referring to FIG. 6, it is shown that the buckles (16) and (17) are disposed underneath the ironing board (22) and the loose end of the strap (15) can be pulled to the upper right hand comer of the page of the drawing as shown in FIG. 6 to tighten it and release tabs (25) on buckle portion (17) can be pushed to release the buckle portions (16) and (17).

Figure 7A:
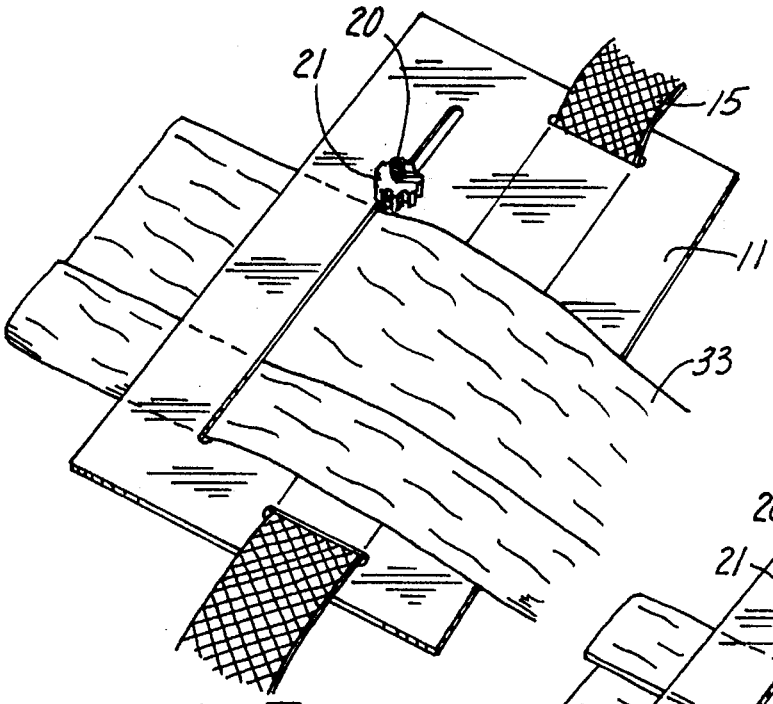
FIG. 7A is a perspective view of the first step of making a double fold binding shown in FIG. 8 and 7B shows the second step of making the double fold binding of FIG. 8.
Figure 8:
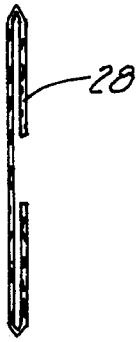
FIG. 8 is a cross sectional view of a completed double fold binding.

Referring now to FIG. 7A, it is noted that what is shown is the first step of making a double folded binding (28) as shown completed in FIG. 8. In FIG. 7A, the nut (21) has been adjusted to the length of the cloth (33) after making one of the folds desired. It is also to be understood that some people prefer to have the fold adjacent to the nut (21) because the smooth portion of the nut (21) tends to aid in the folding process so that the step shown in 7A can be done with the fold nearest to the nut (21) if so desired.

Figure 7B:
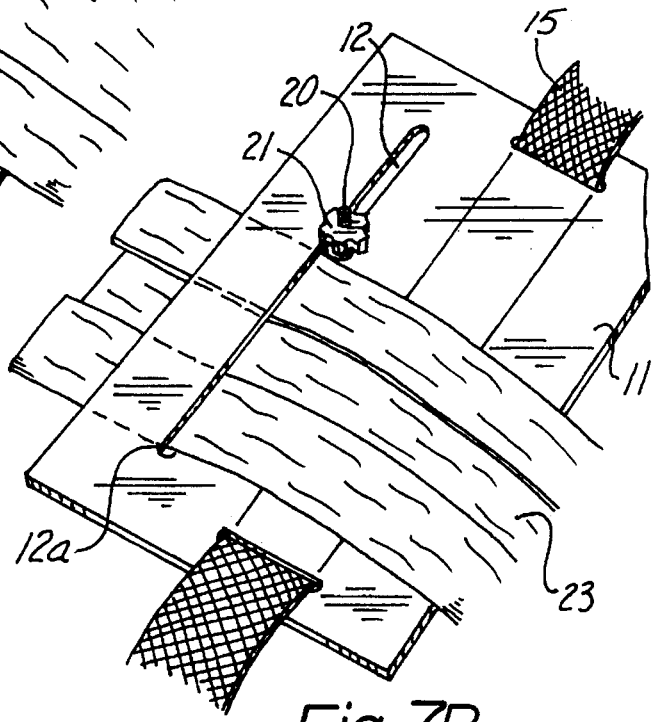

After the cloth (33) is folded the first time, as shown in 7A, it will then be pressed by an iron (24) (not shown) just like the process shown in FIG. 4. After the entire strip of cloth (33) has been folded and pressed the first time, then the cloth strip (23) will be folded on the other side thereof as shown in FIG. 7B, threaded through the slot portion (12*a*) of slot (12) after moving the nut (21) and bolt (18) to conform to the double folded width of the cloth (23). Of course it is then threaded from the top to the bottom of the shortened slot (12*a*) and then pulled through under an iron (24) (not shown) and in the manner shown in FIG. 4 until the entire length of the strip of cloth (23) has been double folded and pressed to the position shown in FIG. 8.

Figure 9:
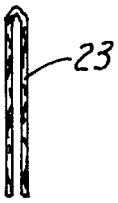
FIG. 9 is a cross sectional view through a single fold binding or ruffle.

FIG. 9 shows the strip of cloth (23) in a cross sectional view wherein it has been folded and pressed to form a binding ready to be sewn to a quilt or the like.

Accordingly it will be appreciated that the preferred embodiment shown herein does indeed accomplish the aforementioned objects. Obviously many modifications and variations of the present invention are possible in light of the above teachings. It is therefore to be understood that, within the scope of the appended claims, the invention may be practiced otherwise than specifically described.

I claim:

1. A method of using a binding tool of a type including a tool body having a top side and a bottom side and a slot disposed through said body for receiving a strip of cloth to be folded comprising the steps of:

a) placing said body member onto top of an ironing board whereby said slot extends from the top of the ironing board upwardly through the top of the body member;

b) folding one end of a strip of cloth;

c) threading said one folded end of cloth through said slot;

d) placing a heated iron on a portion of said folded strip of cloth; and e) pulling on said one end of folded cloth to pull the rest of the strip of cloth through the slot whereby it is folded and simultaneously pulling the folded portion of the cloth between the heated iron and the top surface of the ironing board whereby the cloth is folded and pressed to cause it to retain its folded condition.

2. The method of claim 1 including the step of adjusting the width of the slot to correspond to the desired width of the cloth in a folded condition.

3. The method of claim 2 including the step of attaching the body member to the ironing board so that it will not move during said pulling step (e).

4. The method of claim 1 wherein said cloth is folded in half at its midway line.

5. The method of claim 1 wherein said cloth is folded by said steps (a), (b), (c), (d) and (e) along a line substantially to one side of said midway line to form a folded portion on one side thereof and is again folded by using steps (b), (c), (d) and (e) again by folding along the other side of the strip of cloth to cause both sides of the strip of cloth to have a folded portion thereon.

6. The method of claim 5 including the step of adjusting the width of said slot to conform to the width of the strip of cloth in its folded condition as it is pulled through the slot.

7. The method of claim 1 including the step of keeping the unfolded cloth above the tool body during the steps (c), (d) and (e) and causing the folded portion of the strip of cloth to pass under the tool body during steps (c), (d) and (e).

* * * * *